US009953622B2

(12) United States Patent
Campling

(10) Patent No.: US 9,953,622 B2
(45) Date of Patent: Apr. 24, 2018

(54) CAPO

(71) Applicant: C7th Limited, Peterborough (GB)

(72) Inventor: Nicholas John Campling, Peterborough (GB)

(73) Assignee: C7th Limited (GB)

( * ) Notice: Subject to any disclaimer, the term of this patent is extended or adjusted under 35 U.S.C. 154(b) by 0 days.

(21) Appl. No.: 15/264,935

(22) Filed: Sep. 14, 2016

(65) Prior Publication Data

US 2018/0075825 A1 Mar. 15, 2018

(51) Int. Cl.
*G10D 3/04* (2006.01)

(52) U.S. Cl.
CPC ..... *G10D 3/043* (2013.01)

(58) Field of Classification Search
CPC ..... G10D 3/043; G10D 3/08
USPC ..... 84/318
See application file for complete search history.

(56) References Cited

U.S. PATENT DOCUMENTS 3,823,247 A * 7/1974 Bauerfeind ..... G10D 3/043 84/318
4,334,457 A * 6/1982 Spoonts, III ..... G10D 3/043 84/318

OTHER PUBLICATIONS

Paige Musical Products, The Original Capo, http://www.paigecapo.com/product_display, pp. 1-3.

* cited by examiner

*Primary Examiner* — Kimberly Lockett
(74) *Attorney, Agent, or Firm* — Endurance Law Group PLC

(57) ABSTRACT

A capo (10) suitable for a twelve string guitar, where string pairs of different gauges are used. The capo (10) includes a clamp arm (11) with a contact surface (12) for contacting the strings that includes a plurality of inclined portions (18) relative to a lateral extent of the clamp arm (11). The nature of the inclined portions (18) is such that adjacent strings ($1^{st}$ to $6^{th}$) of different gauges can be contacted with relatively even pressure upon the fingerboard (21).

8 Claims, 1 Drawing Sheet

CAPO

The present invention relates to a capo, particularly a capo suited for use with a twelve-string guitar.

BACKGROUND TO THE INVENTION

A capo (sometimes referred to as a capodastro, capodaster, capotasto or cejilla) is a well-known device used with a stringed instrument having a neck and a set of strings extending along the length of the neck. The capo, when applied to an instrument neck, serves to clamp the strings against a fingerboard and, in particular, between or against one of the number of fret bars disposed along the length of fingerboard. In practice, a capo serves to reduce the effective length of the strings and therefore adjust the pitch; i.e. the pitch is raised as the effective length of a string is shortened. The part of the capo which contacts the strings is usually a resilient pad that prevents damage to the strings from the clamping force.

A twelve-string guitar is a steel-string guitar with twelve strings in six courses, intended to produce a fuller and more ringing tone than a standard six-string guitar. Typically, the strings of the lower four courses are tuned in octaves (a heavy gauge wound string paired with a light gauge wound or non-wound string), with those of the upper two courses tuned in matching pairs (pairs of identical lighter gauge strings). The lower four string pairs are usually arranged such that the first string of each pair, as struck on a downward strum, is the higher octave string; although it is known to reverse this arrangement, such as on a Rickenbacker® electric 12 string guitar. The gap between the strings within each dual-string course is narrow, such that the strings of each course are fretted and plucked as if they were a single string.

As with a six string guitar, a capo can be installed upon a twelve string guitar neck, although it may need to be larger (longer clamping arm) to accommodate the wider neck and extra strings. With a conventional capo the clamping force also generally needs to be greater in order to ensure that the lighter gauge strings make sufficient contact with a fret to result in a clear tone. The consequence of greater clamping pressure, sometimes even right down to the fingerboard, is that it pulls all the strings (predominantly the fatter gauge strings) out of tune and they must be retuned after application or removal of the capo. This presents an undesirable situation when a quick changeover between capo positions is needed during a performance.

To address the problem of clamping differing string gauges in close proximity to one another Paige Musical Products of Michigan, USA produce a capo featuring an offset bar tube that compensates for the smallest of the E, A, D, and G strings on a 12-string guitar. The tubular sleeve sections of this device result in a stepped profile of annular protrusions from the clamp arm where a minimum pressure can be applied until the strings voice clearly, and the controlled tension ensures reduced buzz or string muting. The tubular bar clamp arm is incorporated into a screw threaded clamp arrangement that can be stored behind the nut when not in use.

While the above solution is generally effective it requires time and concentration for a user to apply the capo since, if re-positioning is required further up the neck, the sleeves must be moved to coincide with the string positions (guitar strings typically diverge slightly from one another between the nut and the bridge).

SUMMARY OF THE INVENTION

The present invention seeks to provide a capo that is suitable for use with a twelve string guitar, which accounts for the clamping of differing string gauges while still being relatively quick to apply.

In a broad aspect of the invention there is provided a capo according to claim 1, with further aspects outlined by the dependent claims. Particularly, by providing a series of ramps on the surface of the resilient string contacting pad, it is possible to contact adjacent light gauge and heavy gauge strings, such as on a twelve string guitar, simultaneously without the need for excessive compression.

The ramps, i.e. a plurality of inclined surfaces relative to the longitudinal axis of the clamping arm, have the appearance of a ratchet-style toothed surface of shallow angles bookended by sharper angles. These are preferably fixed features dimensioned to accommodate a degree of divergence of the strings. In its preferred form a user simply ensures that the G strings are properly located at a mid-portion ramp of the capo contact pad and the remaining strings naturally find contact on the other ramps. The capo may be re-positioned to different locations on the neck and, even with slight divergence of the strings, a secure and even clamping can be achieved. It is possible that the inclined surfaces could be arranged for relative sliding movement therebetween in the direction of the longitudinal axis of the clamp arm but generally it is desirable, if possible, to supply a contact surface with the minimum adjustment necessary by the user.

A contact surface suitable for a twelve string guitar capo according to the invention can be implemented into various capo types, e.g. spring, clutch or screw-tightened, in order to achieve the clamping function. In this sense, the heart of the invention is a contact surface with specific surface features and may be in the form of an insert which can be installed into a cavity on a capo of any type.

The orientation of the ramps will typically allow for a conventional twelve string configuration where the lower four string pairs are arranged so that the first string of each pair, as struck on a downward strum, is the higher octave string; however, the ramp orientation can be reversed in a capo suitable for a guitar configuration where the higher octave string trails the heavy gauge string in the strumming direction. In any event, that part of the capo contact surface intended for clamping contact with the upper two string pairs (B and E) will be relatively flat in accordance with conventional capo design.

The contact surface is preferably formed from a resilient material, e.g. rubber, which is hard enough to maintain the necessary tonal characteristics, yet forgiving enough to accommodate variations in string gauges between different instruments and converging positions.

DETAILED DESCRIPTION OF THE PREFERRED EMBODIMENTS

Figure 1:
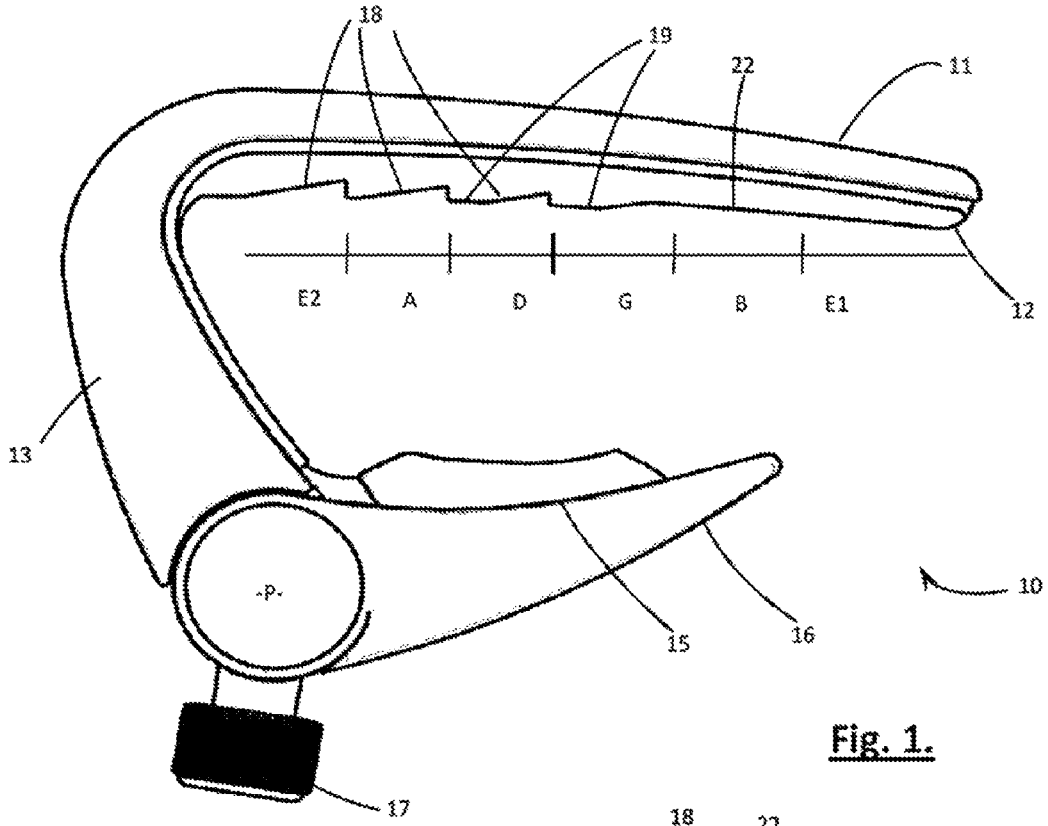
FIG. 1 illustrates side elevation view of a capo incorporating the invention.

FIG. 1 illustrates a capo 10 with typical components well known in the art, e.g. a top or clamp arm 11 upon which is mounted a resilient string facing/contacting pad 12. A side arm 13 extends perpendicularly to the clamp arm 11 to connect it with a pivot point P and opposing arm/pad 15, including a levered support arm 16. This style of capo is based upon the disclosure of U.S. Pat. No. 7,939,736 although, as stated previously, any known capo type may incorporate the invention. In practice, in this capo type, an adjustor screw 17 is turned to adjust the clamping force between a spring biased pad 16 and clamp arm 11. Support arm 15 is used as a quick release lever. In other forms of capo the opposing arm 15 may be a single piece urged toward clamp arm 11 to cause (e.g. by spring bias) or maintain (e.g. by a releasable clutch) a clamping force. Some capos may not utilize an opposing "arm" at all, but feature some other element such as a strap which cooperates with the clamp arm 11 to provide a clamping force to the strings. All such configurations are anticipated as relevant to utilize the invention.

Figure 2:
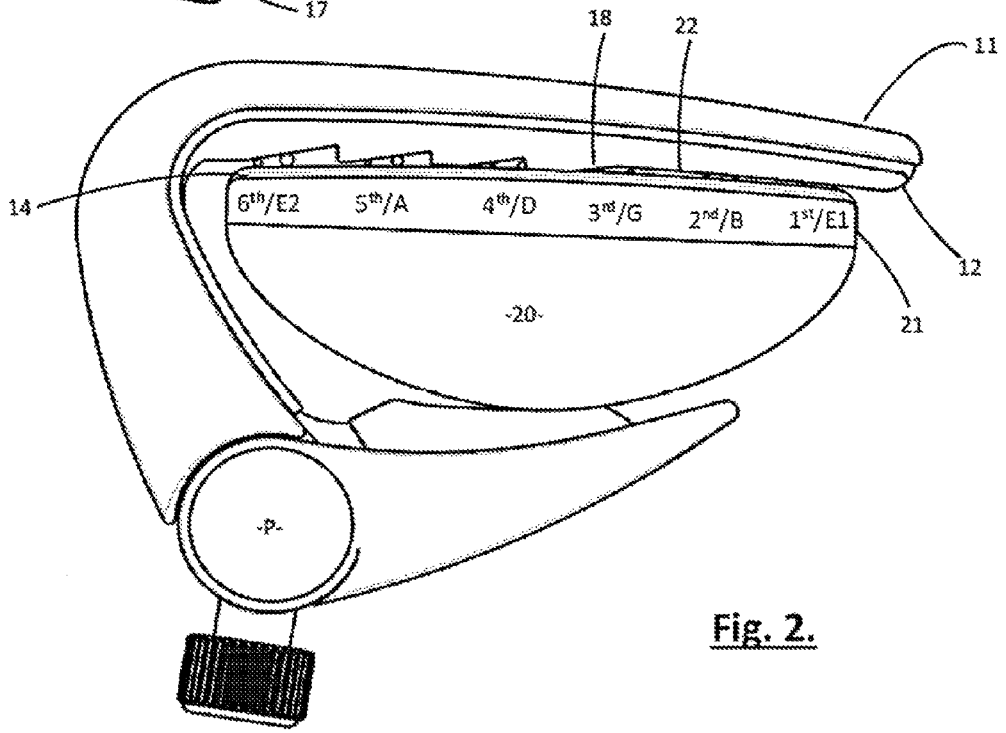
FIG. 2 illustrates a further view that includes a cross section of a guitar neck with a capo applied according to the invention in place.

The focus of the invention lies in the functional configuration of the resilient string contacting pad 12 and how it is adapted for use with a twelve string guitar. Specifically, pad 12 includes a series of inclined surfaces or ramps 18, with the general appearance of serrations or a ratchet surface, that provide a graduated contact area local to a string pair upon a twelve string guitar neck 20 as illustrated by FIG. 2.

Six "zones" (e.g. E1, B, G, D, A, E2) corresponding to each string pair are shown in FIG. 1, i.e. $1^{st}$ string=E1, $2^{nd}$ string=B, $3^{rd}$ string=G, $4^{th}$ string=D, $5^{th}$ string=A and $6^{th}$ string=E2. These correspond to standard tuning but, of course, the invention is adaptable to any string gauge/tuning configuration. The strings shown in contact with a fret bar 14 at each zone are represented by FIG. 2.

The illustrated capo is intended to clamp over the strings on a finger board 21 in such a way as to impart enough pressure to adjust the pitch according to the position of the capo and the fret 14 against which the strings press (equivalent to a bar chord performed by a user's finger), without over-tightening which would cause a sharpening of the note. Due to the use of a series of inclined surfaces this becomes possible on a twelve-string guitar. Specifically, the inclined surface 18 allows for a fatter gauge string to contact finger board 21 at the same time and pressure as a thinner gauge string directly adjacent, whereas a flat surface would apply more pressure to the fatter gauge string compared to the thinner gauge string against the fret bar 14.

In a preferred method of use, the capo 10 is initially positioned longitudinally at a desired fret (not seen in the drawings) upon the neck 20 by locating the $3^{rd}$ (G) string pair against the ramp 18 of zone G, or at least locating the lighter gauge G string against ramp 18 while the heavier gauge G string contacts against a flat portion 22 of the capo pad 12. The significance of the configuration is that an even pressure is applied to both strings of the pair which will maintain relative tuning for both.

Ramps 18, as illustrated, may be associated with a leveled off portion 19 at the ramp peak which contacts with the lighter gauge of a string pair or directly with the finger board 21. The extent of these portions depends on optimum dimensions being determined by a skilled person.

It will be apparent that a section, portion 22, of the contact pad 12 has a relatively conventional, i.e. "flat", configuration (although it is not necessarily flat but curved to match lateral curvature of the fingerboard 21) at the location of the B and E1 zones because these string pairs are not different gauges, but doubles of the same gauge. Accordingly, there is no need for an inclined surface at these positions and, in fact, it would be undesirable because otherwise one of the strings would be subject to greater clamping force than the other.

If the exact dimensions of a guitar neck and string location are known then it is possible to provide a bespoke pad 12 for that guitar, although it is most practical in a commercial sense to supply a universal pad dimension to operate with multiple guitar types. Dimensions have been chosen by experiment to account for an optimum number of capo locations longitudinally up and down an instrument neck. It would be possible to user-fit a replacement/alternative pad 12 into clamp arm 11 which was best suited to the dimensions of a particular guitar and/or fret location, however, most capo positions occur around the $1^{st}$ to, say, $7^{th}$ fret so it is expected that a single pad 12 can accommodate multiple fret positions with respect to the contact points of string pairs with a ramped surface.

Any alternative embodiments of the invention are intended to achieve an effect as illustrated. For example, the concept of the invention is applicable not only to twelve string guitars exclusively, but also to any other instrument that may have string pairs of different string gauges, regardless of the total number of strings. Indeed, a capo contact surface according to the invention may still be used upon the neck of a conventional six (or other) string guitar/instrument. As previously mentioned, a reversed inclined pattern may be incorporated where the heavier and light gauge string pairs are similarly reversed. The illustrated form shows a "standard" 12 string guitar configuration.

It will be clear to those skilled in the art that the invention can be implemented with available materials and manufacturing techniques. Indeed, the invention can be applied to most known capo ranges, independent of the clamping mechanism adopted.

The invention claimed is:

1. A capo for use with a stringed instrument having a neck with a back and a fingerboard with string pairs of different gauges that extend longitudinally over said finger board, the capo including:

a clamp arm configured to, in use, extend laterally across the finger board over the strings;

a contact surface associated with the clamp arm for contacting the strings in use;

wherein the contact surface includes a plurality of inclined portions relative to the lateral extent of the first arm, each inclined portion being arranged to engage a respective string pair, the respective string pair comprising two strings having different gauges, and to slope transversely across the respective string pair when the capo is attached to the neck of the stringed instrument.

2. The capo of claim 1 wherein the contact surface includes a noninclined or flat portion, in addition to the plurality of inclined portions, suitable for engagement with instrument strings that are not string pairs of different gauges.

3. The capo of claim 1 wherein one or more of the inclined portions includes a leveled-off portion.

4. A string contacting pad for incorporation into a clamp arm of a capo, wherein the contact surface includes a plurality of inclined portions, each inclined portion being arranged to engage a respective string pair, the respective string pair comprising two strings having different gauges, and to slope transversely across the respective string pair when the capo is attached to the neck of the stringed instrument.

5. The string contacting pad of claim 4 wherein the contact surface includes a non-inclined flat portion, in addition to the plurality of inclined portions, suitable for engagement with remaining strings that are not string pairs of different gauges.

6. The string contacting pad of claim 4 wherein one or more of the inclined portions includes a leveled-off portion.

7. The string contacting pad of claim 4 made substantially of a resilient material that will firmly contact but not damage/deform the instrument strings.

8. The string contacting pad of claim 1 made substantially of a resilient material that will firmly contact but not damage/deform the instrument strings.

* * * * *